US011077542B2

(12) United States Patent
Waterman et al.

(10) Patent No.: US 11,077,542 B2
(45) Date of Patent: Aug. 3, 2021

(54) METAL CONNECTOR ADAPTOR FOR A FASTENING TOOL

(71) Applicant: Stanley Fastening Systems, L.P., North Kingstown, RI (US)

(72) Inventors: Richard Waterman, North Kingstown, RI (US); Christopher Boyle, Warwick, RI (US)

(73) Assignee: STANLEY FASTENING SYSTEMS, L.P., North Kingstown, RI (US)

( * ) Notice: Subject to any disclaimer, the term of this patent is extended or adjusted under 35 U.S.C. 154(b) by 695 days.

(21) Appl. No.: 14/703,012

(22) Filed: May 4, 2015

(65) Prior Publication Data

US 2015/0239113 A1 Aug. 27, 2015

Related U.S. Application Data

(60) Provisional application No. 61/898,053, filed on Oct. 31, 2013.

(51) Int. Cl.
*B25C 7/00* (2006.01)
*B25C 1/00* (2006.01)

(52) U.S. Cl.
CPC ..... *B25C 7/00* (2013.01); *B25C 1/00* (2013.01); *Y10T 29/49826* (2015.01)

(58) Field of Classification Search
CPC ..... B25C 1/00; B25C 7/00; Y10T 29/49826; B25F 1/02; B25F 5/021; B25F 5/02; B23B 49/008; F16B 2/02; F16B 2/04
USPC ..... 227/123, 120
See application file for complete search history.

(56) References Cited

U.S. PATENT DOCUMENTS 2,783,468 A * 3/1957 Schwartz ..... B25C 3/002 227/116
2,851,689 A 9/1958 McIlvin
2,905,942 A * 9/1959 Grey, Jr. ..... B25C 5/06 227/123
3,011,169 A 12/1961 Cast et al.
3,273,777 A * 9/1966 Juilfs ..... B25C 5/1665 227/123
3,606,128 A * 9/1971 Cast et al. ..... B25C 1/008 227/1

(Continued)

FOREIGN PATENT DOCUMENTS

DE 1440773 A1 * 7/2004 ..... B08B 15/04
EP 1621291 A1 2/2006

(Continued)

OTHER PUBLICATIONS

David, Radu—European Search Report re: related application No. EP15166473—Mar. 10, 2016—4 pages—The Hague.

*Primary Examiner* — Nathaniel C Chukwurah
*Assistant Examiner* — Lucas E. A. Palmer
(74) *Attorney, Agent, or Firm* — Rhonda Barton

(57) ABSTRACT

A metal connector adaptor for a fastening tool having a body including a drive channel extending therethrough. A pendulum member is pivotably connected to the body within the drive channel and biased toward a front portion of the drive channel. A pair of claws is pivotably connected to the body and can surrounding the drive channel so as to retain a lower contact arm of the fastening tool. A guide member protrudes from the lower portion of the body to align the adaptor with designated holes in a metal connector.

18 Claims, 10 Drawing Sheets

(56) References Cited

U.S. PATENT DOCUMENTS 4,454,650 A * 6/1984 Silver ..... A41H 37/04 227/149
4,467,952 A * 8/1984 Morrell, Jr. ..... B25C 5/1665 227/123
4,671,444 A * 6/1987 Oliver ..... B25C 5/0271 227/108
4,928,867 A * 5/1990 Jensen ..... B25C 7/00 227/130
5,238,167 A * 8/1993 Howard ..... B25C 7/00 227/110
5,316,200 A * 5/1994 Wallin ..... B27F 7/13 227/119
5,452,835 A * 9/1995 Shkolnikov ..... B25C 1/047 227/110
5,733,089 A * 3/1998 Albright ..... B21J 15/32 221/310
5,743,455 A * 4/1998 Holliday ..... B25C 1/00 227/119
5,803,338 A * 9/1998 Singer ..... B25C 1/005 227/110
5,810,239 A * 9/1998 Stich ..... B25C 7/00 227/119
5,821,407 A 10/1998 Sekiguchi et al.
5,897,045 A * 4/1999 Olvera ..... B25B 21/002 227/107
6,209,770 B1 * 4/2001 Perra ..... B25C 1/005 227/120
6,264,408 B1 * 7/2001 Lung ..... B23B 49/008 279/157
6,279,808 B1 * 8/2001 Larsen ..... B25C 1/00 227/119
6,286,742 B1 9/2001 Mukoyama
6,431,428 B1 * 8/2002 Chen ..... B25C 1/00 227/119
6,578,749 B1 * 6/2003 Shen ..... B25C 1/003 227/119
6,688,611 B2 * 2/2004 Gifford ..... B23Q 3/12 279/143
6,739,490 B1 * 5/2004 Shkolnikov ..... B25C 1/08 227/109
6,968,939 B1 * 11/2005 Mauer ..... B21J 15/025 198/468.8
7,354,230 B2 4/2008 Bauman
RE41,265 E * 4/2010 Perra ..... B25C 1/008 227/142
8,056,785 B2 * 11/2011 Gosis ..... B25C 7/00 227/140
8,132,990 B2 3/2012 Bauman
8,181,712 B2 * 5/2012 Liu ..... B25C 7/00 173/1
8,220,367 B2 7/2012 Hsu
8,220,687 B2 * 7/2012 Yamamoto ..... B25C 1/008 227/120
8,356,534 B2 * 1/2013 Hale ..... B25B 23/10 81/418
8,387,846 B2 * 3/2013 Francis ..... B25C 7/00 227/148
8,430,290 B2 * 4/2013 Tebo ..... B25C 1/005 227/107
8,833,628 B2 * 9/2014 Schwartzenberger .. B25C 1/188 227/109
9,527,196 B2 * 12/2016 Segura ..... B25C 1/005
2003/0062394 A1 * 4/2003 Wang ..... B25C 5/1665 227/123
2003/0230622 A1 * 12/2003 Rotharmel ..... B25C 1/184 227/120
2004/0050899 A1 * 3/2004 Canlas ..... B25C 7/00 227/119
2005/0200087 A1 * 9/2005 Vasudeva ..... B25F 3/00 279/143
2006/0060629 A1 * 3/2006 Peng ..... B25C 1/188 227/119
2006/0289595 A1 * 12/2006 Shen ..... B25C 7/00 227/8
2007/0039992 A1 * 2/2007 Shen ..... B25C 7/00 227/120
2008/0277446 A1 * 11/2008 Yamamoto ..... B25C 1/008 227/139
2009/0166394 A1 7/2009 Gyorkos
2012/0138656 A1 * 6/2012 Xu ..... B25C 1/003 227/109
2012/0241048 A1 * 9/2012 Kato ..... B25F 5/021 144/136.95
2012/0241049 A1 * 9/2012 Kato ..... B25F 5/02 144/136.95
2013/0320065 A1 * 12/2013 Gregory ..... B25C 1/00 227/119
2014/0015205 A1 1/2014 Viuf
2014/0138422 A1 * 5/2014 Ronconi ..... B25C 1/001 227/18
2015/0053449 A1 * 2/2015 Henke ..... E01B 29/26 173/128
2016/0114472 A1 * 4/2016 Holubarsch ..... B25F 5/026 16/426
2016/0319850 A1 * 11/2016 Kamen ..... F16B 2/02

FOREIGN PATENT DOCUMENTS

GB 2289013 A * 11/1995 ..... B23Q 1/28
JP 63-074508 A 4/1988
JP 2015127075 A * 7/2015 ..... B25F 5/02

* cited by examiner

METAL CONNECTOR ADAPTOR FOR A FASTENING TOOL

CROSS-REFERENCE TO RELATED APPLICATION

The present application claims priority under 35 U.S.C. § 119 to U.S. Provisional Patent Application Ser. No. 61/989,053 filed on May 6, 2014, the entire contents of which are incorporated by reference in their entirety.

BACKGROUND OF THE INVENTION

Field of the Invention

The present invention generally relates to fastening tools, and more specifically relates to mechanisms that adapt the fastening tool for different uses such as connecting metal connectors to a workpiece.

Description of the Related Art

The construction industry has seen an increase in the use of metal connectors when joining two workpieces together. For example, joist hangers are commonly used in the construction of floors in buildings, as well as outdoor decks. Also, L-shaped metal connectors are used to connect and/or reinforce two workpieces that are joined perpendicularly, such as when connecting the framing of two walls. Conventional fastening tools, such as pneumatic nailers, have been difficult to use in metal connector applications because of the size of such tools. For example, a conventional pneumatic nailer used for framing applications is designed to drive nails that are 2-4 inches in length and have diameters of about 0.113-0.162 inches. However, fasteners that are used to attach metal connectors to workpieces are typically about 1.5-2.5 inches in length and have diameters of about 0.131-0.162 inches. While framing nailers may be used to drive longer metal connector fasteners, they are typically not configured to drive shorter metal connector fasteners that are 1.5 inches in length.

Moreover, the design of conventional pneumatic nailers makes it difficult to accurately locate a fastener into the hole of the metal connector due to design of the nose and the contact arm. A conventional contact arm is biased to extend past the nose of the fastening tool so that when the contact arm is pressed against the workpiece, the contact arm cooperates with the trigger to cause the fastening tool to actuate and drive the fastener into the workpiece. In many applications, such as framing and finishing, the fastener may be located in a range of locations, i.e. the precise location of the fastener may not be important. Conversely, when driving a fastener through a hole of a metal connector, the precision of the drive is important because of the risk of damaging the nailer or the metal connector. Although there have been attempts to use the tip of the fastener that is about to be driven as the hole locator, providing a robust and relatively inexpensive and easy to install mechanism for locating the hole in a metal connector has been challenging. Currently, fastening tools, such as framing nailers, require the user to remove the lower contact arm from the tool, before an adaptor is installed.

SUMMARY OF THE INVENTION

Therefore, it is an aspect of the present invention to provide a fastening tool that allows an adaptor to be readily attached to the nosepiece, without the re-configuration of the tool components, the adaptor providing a protruding tip that can be used to locate a hole in a metal connector.

A fastening tool adaptor guides the installation of connector nails into designated holes in a connector plate. In an embodiment of the present invention, a metal connector adaptor guides the installation of metal connector nails into designated holes in a metal connector plate. The metal connector adaptor is capable of being installed around the nosepiece of a fastening tool, such as a pneumatic, cordless, or gas powered framing nailer, without the removal of any components and capable of being installed without tools.

In an embodiment of the present invention, the adaptor has a pair of claw-like members, a body, and a protruding tip. The body surrounds a portion of a contact arm of the fastening tool, while the claw-like members retain the contact arm in the body. The protruding tip serves as a guide member to position the adaptor in the desired location for driving the fastener, such as a nail, from the fastening tool. Specifically, the protruding tip or guide member aligns the adaptor in the designated holes in the metal connector plate. The design of the present invention allows the user to install the metal connector adaptor over a portion of the contact arm of the fastening tool, thereby reducing the installation time of the adaptor.

Installation of the adaptor on the fastening tool is accomplished by closing the pair of claw-like members over the lower contact arm and nose of the fastening tool. The inner geometry of the adaptor body contacts the lower contact arm so that the lower contact arm can engage the safety of the tool. The pair of claw-like members encase the top of the lower contact arm to support the adaptor and prevent the adaptor from moving down (away from the tool housing) while the inner geometry of the adaptor prevents the adaptor from moving up (toward the tool housing). The inner geometry also constrains the adaptor from moving left or right, laterally, with respect to the nosepiece assembly.

More specifically, embodiments of the present invention include an adaptor having a body having a front portion, a rear portion, an upper portion and a lower portion and a drive channel extending in a direction from the upper portion to the lower portion. A pendulum member is pivotably connected within the body and biased toward a front portion of the drive channel. A pair of claws is pivotably connected to the body and can surrounding the drive channel so as to retain a contact arm therein. A guide member protrudes from the lower portion of the body and aligns the adaptor with designated holes in a metal connector. The pair of claws has an open position and a closed position and is biased in the closed position. A button member can be mounted fixedly and extend laterally from the body. The button member can be adapted to be manually depressed to reposition the pair of claws from the closed position to the open position.

In another embodiment of the present invention, a fastening tool includes a housing, a nosepiece assembly carried by the housing, the nosepiece assembly having a fastener drive track; an engine carried by the housing and configured to drive a fastener out of the drive track and into a workpiece during a drive stroke; a contact arm including an upper contact arm portion and a lower contact arm portion, the lower contact arm portion being movably mounted to the nosepiece assembly and operatively coupled to the upper contact arm portion; a trigger configured to move the lower contact arm portion; a magazine assembly constructed and arranged to feed successive leading fasteners from a supply of fasteners contained therein into the drive channel; and an adaptor being configured to receive the lower contact arm. The adaptor includes a body having a front portion, a rear portion, an upper portion and a lower portion. A drive channel is disposed through a center portion of the body and receives the lower contact arm. The adaptor also includes a pendulum member pivotably connected to the body, within the drive channel, and biased toward the lower contact arm; a pair of claws pivotably connected to the body and surrounding the lower contact arm in the drive channel; and a guide member for guiding a fastening member from the magazine assembly. The guide member protrudes from the lower portion of the body.

In a further embodiment, the present invention includes a method of attaching an adaptor to a contact arm of a fastening tool including providing a fastening tool having a lower contact arm portion and an upper contact arm portion; providing an adaptor having a drive channel through a center portion thereof and a pair of claws surrounding the drive channel; opening the pair of claws of the adaptor; inserting the lower contact arm portion into the drive channel; and closing the pair of claws of the adaptor around the lower contact arm.

BRIEF DESCRIPTION OF THE DRAWINGS

Embodiments of the invention will now be described, by way of example only, with reference to the accompanying schematic drawings in which corresponding reference symbols indicate corresponding parts.

DETAILED DESCRIPTION OF THE PREFERRED EMBODIMENTS

Figure 1:
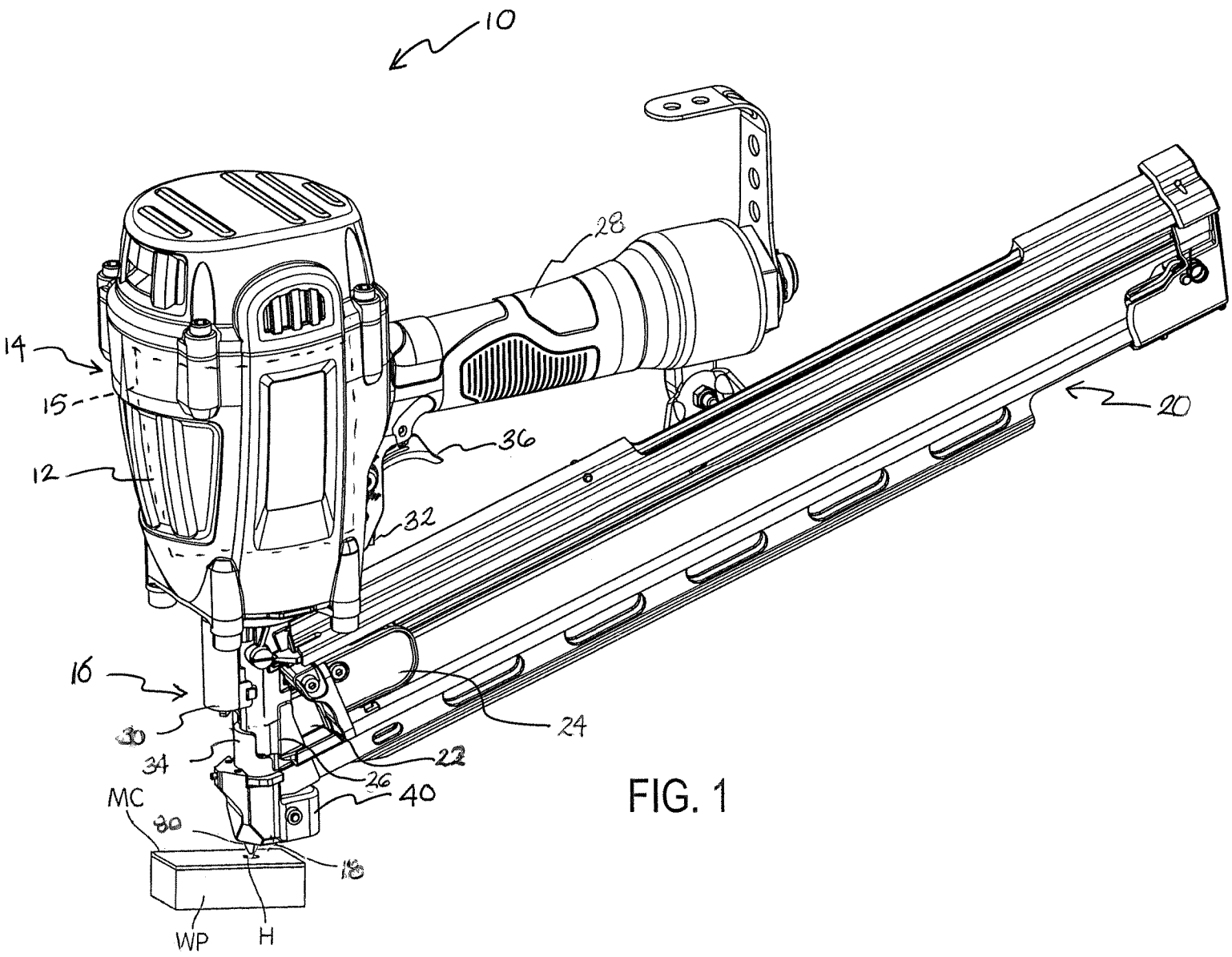
FIG. 1 is a perspective view of a fastening tool having a metal connector adaptor according to an embodiment of the present invention.

With reference to FIG. 1 of the drawings, a fastening tool 10 is illustrated to include a tool body and a metal connector adaptor 40 that is constructed in accordance with the teachings of the present disclosure. In the particular example illustrated, the tool body is a fastening tool. The tool 10 includes a housing 12. The housing 12 is preferably constructed from a lightweight yet durable material, such as magnesium. The housing 12 includes an engine receiving portion 14 configured to contain an engine 15 that is constructed and arranged to drive a fastener into a workpiece WP. The engine 15 may be any suitable engine for driving a fastener into a workpiece WP that converts stored energy into kinetic energy to drive a fastener. For example, the engine may be a pneumatic-type engine that is powered by compressed air, or the engine may be powered by a battery, chemical reaction, etc., as is known in the art. Embodiments of the present invention are not limited to any specific type of engine.

The tool 10 also includes a nosepiece assembly 16 that is connected to the housing 12. The nosepiece assembly 16 defines a fastener drive track 18 therein. A fastener driver is movably mounted in the housing and configured to enter the drive track and drive successive leading fasteners into the workpiece.

A magazine assembly 20 is constructed and arranged to feed successive leading fasteners from a supply of fasteners (not shown) contained therein along a feed track 22 and into the drive track 18. The supply of fasteners is urged toward the drive track 18 with a pusher 24 that is biased towards the drive track 18 and engages the last fastener in the supply of fasteners. The magazine assembly 20 is preferably constructed and arranged to supply fasteners that are specifically designed for connecting a metal connector MC, such as, for example, a metal connector plate, with a workpiece WP. That is, the shank diameter of each fastener is sized to pass through a hole H in the metal connector MC, and the head of the fastener is sized to prevent the fastener from passing entirely through the hole H so that the metal connector MC may be fixedly secured to the workpiece WP.

The arrangement of the magazine assembly 20 illustrated in FIG. 1 allows for a compact and lightweight tool 10. In one embodiment, one end of the magazine assembly 20 is preferably connected to a fixed portion 26 of the nosepiece assembly 16 by known methods. In the illustrated embodiment, the magazine assembly may be connected to the handle 28 at an end that is distal to the nosepiece assembly 16. Although the illustrated magazine assembly 20 is configured to receive fasteners that are collated in a stick configuration, it is also contemplated that a magazine assembly that is configured to accommodate fasteners that are collated in a coil may also be used. The illustrated embodiment is not intended to be limiting in any way.

The nosepiece assembly 16 includes a contact arm assembly 30. The contact arm assembly 30 is in communication with a controller (not shown) which communicates with the engine 15 of the fastening tool 10. The contact arm assembly 30 includes an upper contact arm portion 32 and a lower contact arm portion 34 movably mounted to the nosepiece assembly 20 and operatively coupled to the upper contact arm portion 32.

The fastening tool 10 further includes a trigger 36 which is also in communication with the controller. The trigger 36 is configured to move the lower contact arm portion 34. Upon receiving a signal from the trigger 36 and the contact arm assembly 30, the controller signals the engine 15 to initiate a drive stroke With reference to FIGS. 2-6 the adaptor 40 can be coupled to an end of the lower contact arm portion 34. The adaptor 40 is illustrated to include a body 42 having a front portion 44 facing away from the magazine assembly 20, a rear portion 46 facing toward the magazine, an upper portion 48 facing the tool housing 12 and a lower portion 50 configured to be positioned adjacent to the workpiece WP. The upper portion 48 of the body includes a plurality of parallel surfaces or ledges 52, 54, 56. As shown, for example, in FIGS. 2 and 6, a first ledge 52 is located at the front portion 44 of the body 42. A second ledge 54 is located on a lower portion of the body, with respect to the tool, but in a parallel plane to the first ledge. A third ledge 56 is located in a parallel plane lower than the plane on which the second ledge 54 is disposed, at the rear portion 46 of the body 40. The second ledge 54 is disposed between the first ledge 52 and the third ledge 56. As such, the ledges 52, 54, 56 form a tiered upper surface of the adaptor body.

Figure 5:
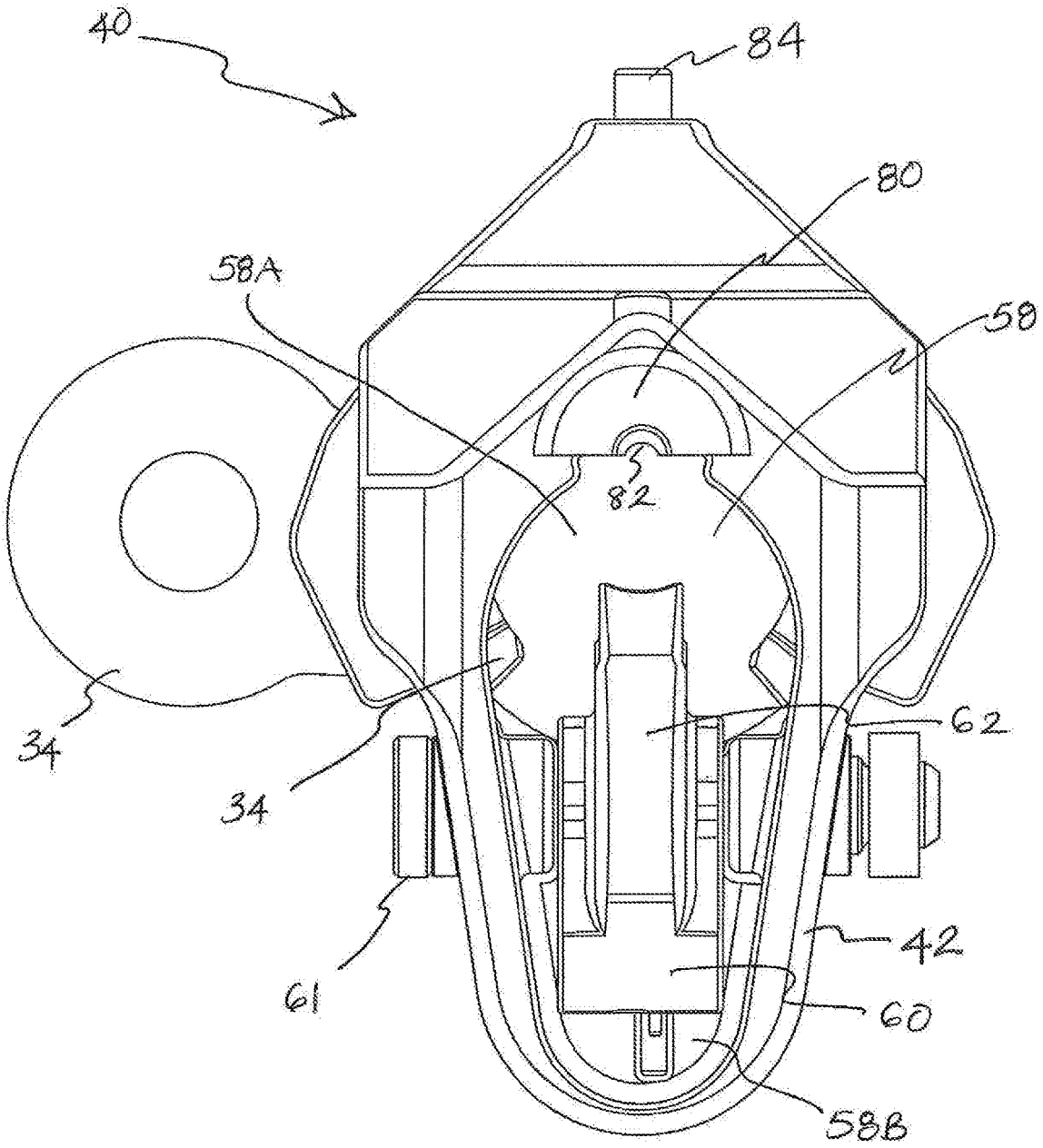
FIG. 5 is a bottom view of the metal connector adaptor according to the embodiment of FIG. 2.
Figure 6:
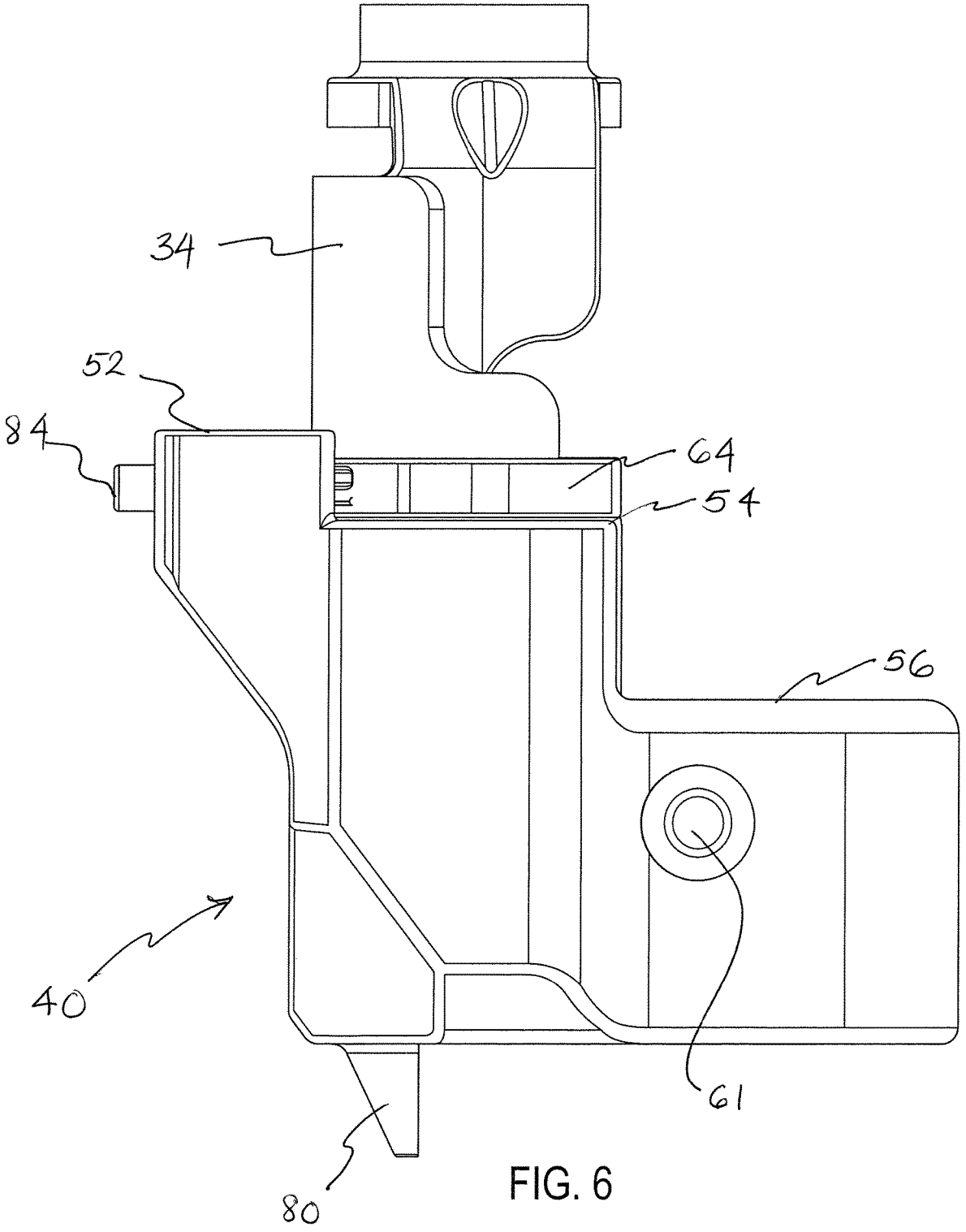
FIG. 6 is a side view of the metal connector adaptor, as installed on a lower contact arm of a fastening tool, according to the embodiment of FIG. 2.

As illustrated for example, in FIG. 5, the body 42 of the adaptor 40 includes a longitudinal drive channel 58 through a center portion thereof. The drive channel extends in a longitudinal direction from the upper portion 48 to the lower portion 50 of the body 42. A forward section 58A of the drive channel 58 seats the lower contact arm 34 within the adaptor 40. The adaptor 40 can be formed from materials including, but not limited to cast steel.

Figure 2:
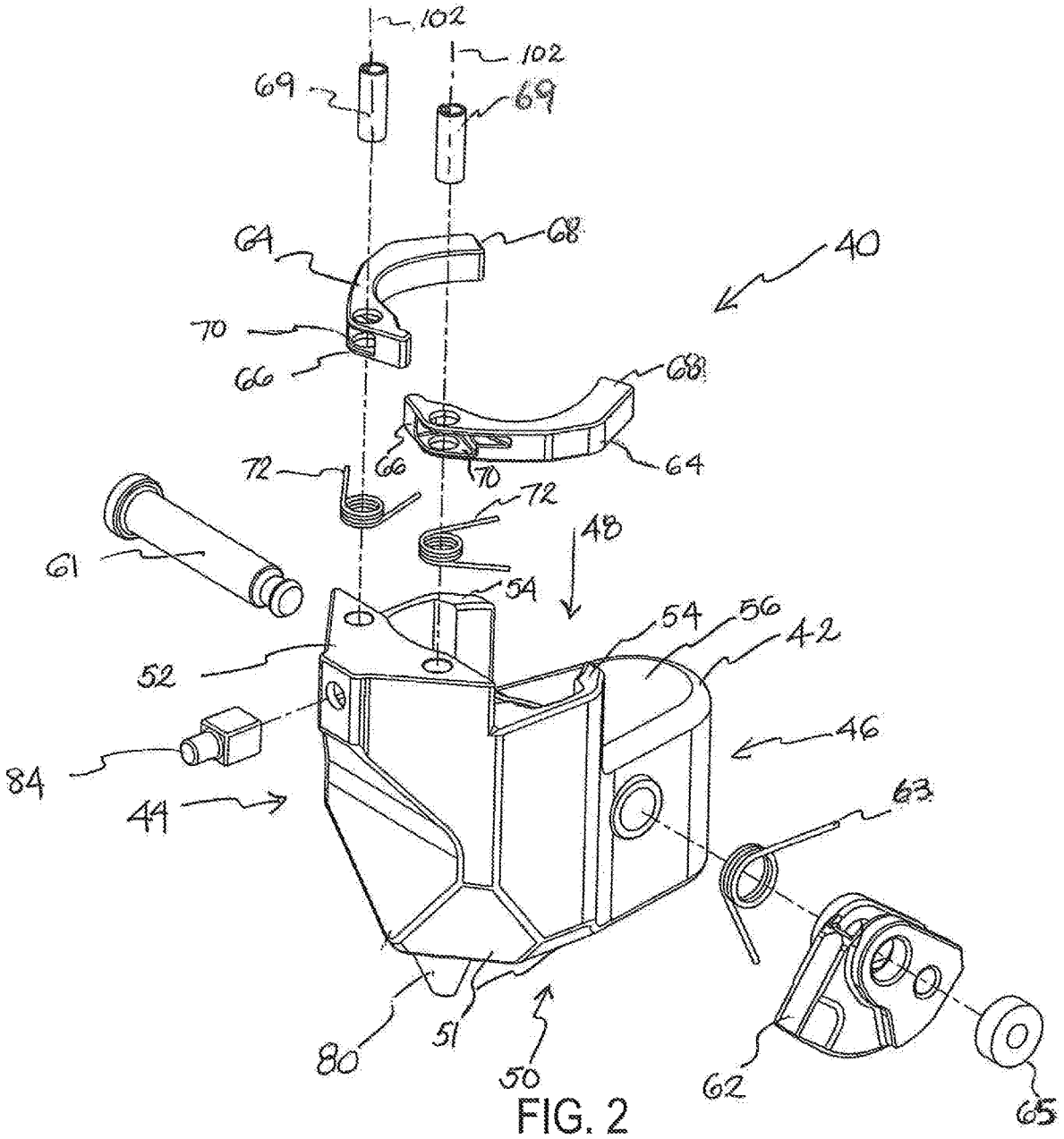
FIG. 2 is an exploded view of the metal connector adaptor according to a first embodiment of the present invention.

A rear section 58B of the drive channel 58 contains a pendulum member 60 pivotably connected to the body 42. The pendulum member 60 pivots on a pin 61 inserted laterally through the adaptor body in a direction perpendicular to the longitudinal aperture that forms the drive channel 58. A torsion spring 63 is disposed around the pin 61 to bias the pendulum member 60 in a direction toward the drive channel. The pin and pendulum member 60 are held in place on the adaptor by a grommet 65. As shown in FIGS. 2 and 5, for example, the pendulum member 60 pivots about an axis lying in a plane intersecting the drive channel 58. The pendulum member 60 can have a triangular shape including a guide face 62 that faces the front portion 44 of the adaptor body. The guide face 62 of the pendulum member 60 includes a concave surface facing the drive channel 58. The guide face 62 serves as a contact surface for the tip of a fastener that is exiting the drive track 18 of the nosepiece assembly 16 and is entering the drive channel 58. The pendulum member 60 keeps the tips of the fasteners pointed toward the front portion 44 of the adaptor body 42 so that the tip of the fastener enters the hole H in the metal connector MC.

Figure 3A:
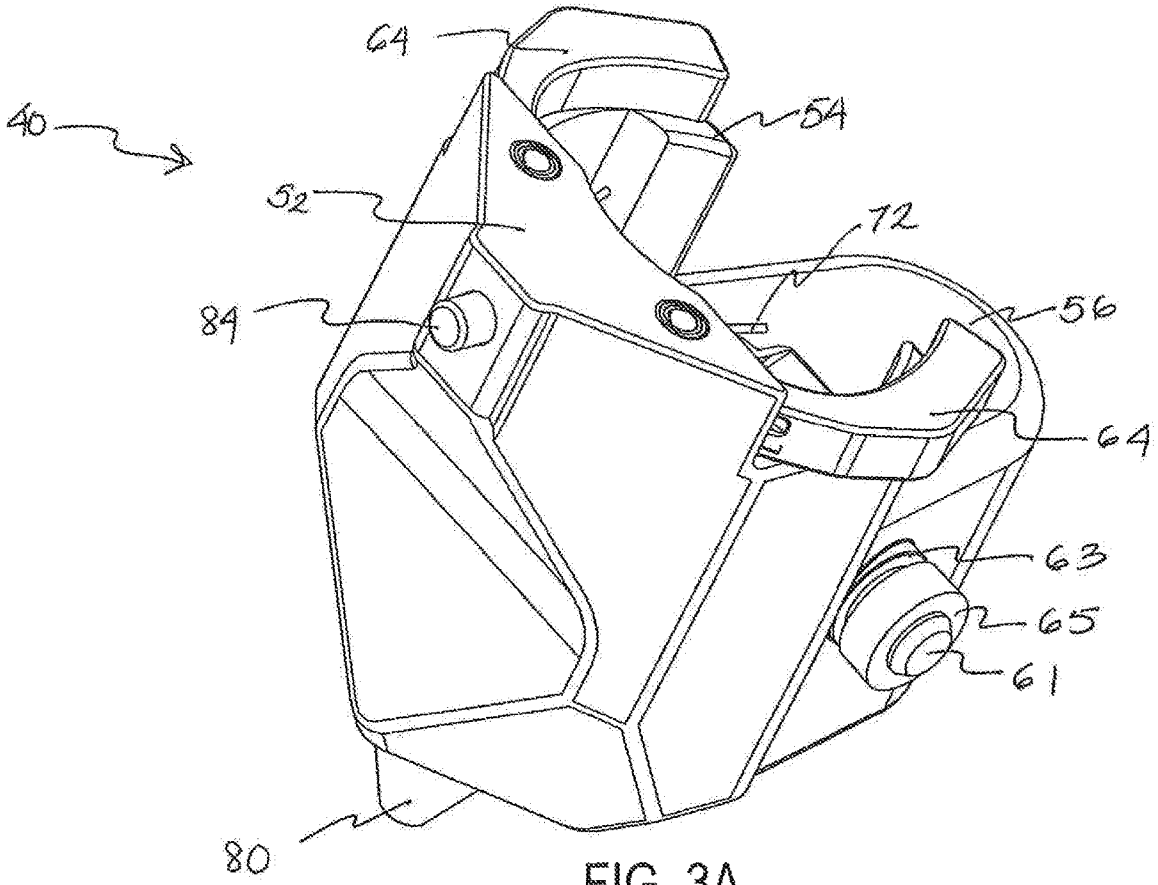
FIG. 3A is a perspective view of the metal connector adaptor according to the embodiment of FIG. 2.
Figure 3B:
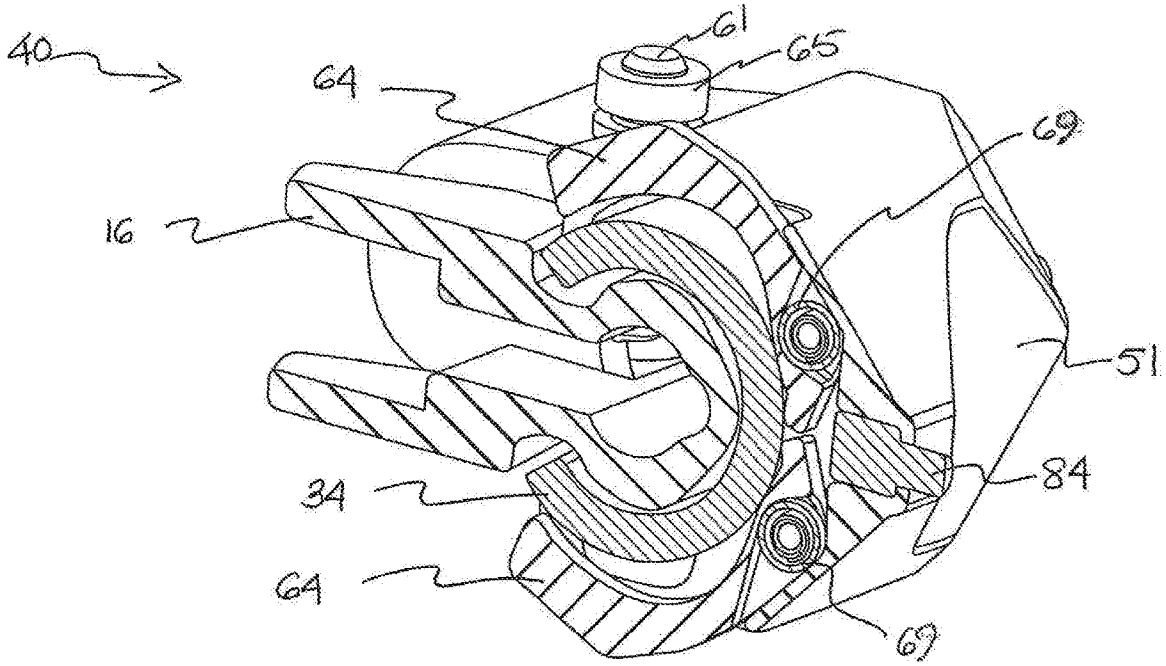
FIG. 3B is a cross-sectional view of the metal connector adaptor according to the embodiment of FIG. 2.
Figure 4:
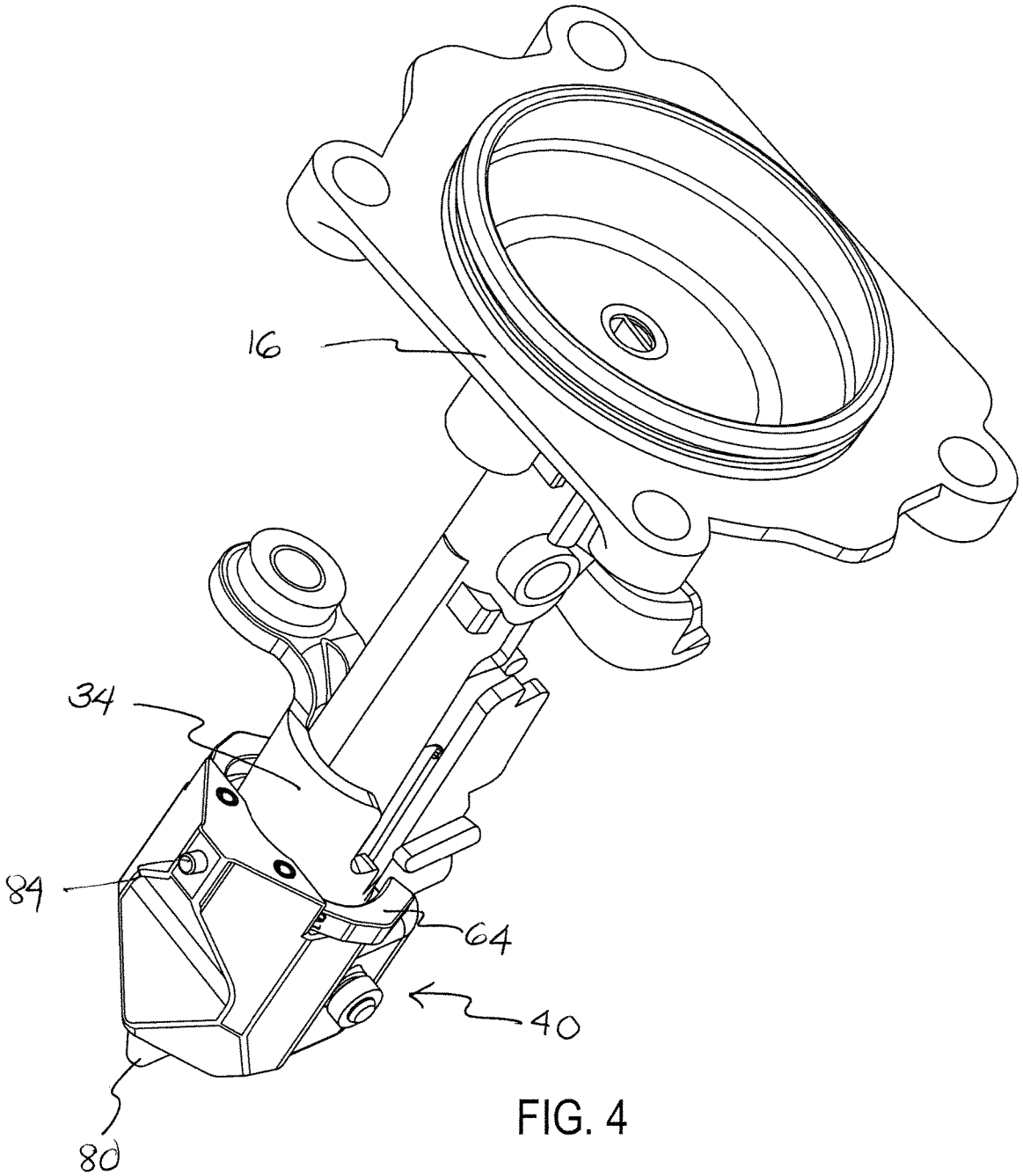
FIG. 4 is a perspective view of the metal connector adaptor, as installed on a lower contact arm of a fastening tool, according to the embodiment of FIG. 2.

As shown in FIGS. 2-4, a pair of claws 64 is provided to hold the lower contact arm 34 in place in the adaptor 40. The claws 64 are pivotably connected on the second ledge 54 of the body surrounding the drive channel 58, such that the lower contact arm 34 and nosepiece assembly 16 inserted into the drive channel are surrounded by the claws 64. In addition, the claws 64 are biased by torsion springs 72 in the closed position toward the center of the drive channel 58, thereby retaining the lower contact arm 34 and nosepiece assembly 16 in the adaptor 40. As a result of the adaptor 40 is connected to the lower contact arm. As a result of the adaptor being connected to the lower contact arm 34, the adaptor also moves up and down with the lower contact arm.

The claws 64 can have any shape so as to conform to the shape of the outer surface of the lower contact arm 34. In the exemplary embodiment shown in FIGS. 2 and 4, the claws 64 can have a substantially arcuate shape that conforms to the substantially arcuate shape of the lower contact arm 34. Each of the claws 64 has a proximal end 66 through which the claw is connected to the front portion 44 of the body 42, and a distal free end 68 extending toward the rear portion 46 of the body. The proximal end 66 includes a cavity 70 on an outer surface thereof for inserting a torsion spring 72 that serves to bias the claws 64 in closed position.

The claws 64 pivot on a pair of roll pins 69 inserted through the proximal end 66 of the claws. The roll pins 69 extend through the first ledge 52 of the adaptor body 42 into the second ledge 54 where the claws are mounted. The torsion spring 72 is arranged around the roll pin 69 such that pivoting the claws 64 into an open position overcomes the spring force and compresses the torsion springs. Each roll pin 69 has an axis 102 that is parallel to the longitudinal direction of the aperture that forms the drive channel 58. As such, each claw pivots separately about a roll pin on an axis 102 that is parallel to the drive channel. The claws 64, torsion spring 72 and roll pins 69 can be made of any material, including, but not limited to steel.

As illustrated in FIGS. 1, 2, 3, 4 and 6, a guide member 80 is provided on the adaptor body for aligning the adaptor with designated holes in a metal connector MC, such as a metal connector plate. The guide member 80 protrudes from the lower front portion of the body in order to locate the hole H in the metal connector MC. The guide member 80 is tapered in a direction away from the lower portion 50 of the body, toward the workpiece WP. The guide member 80 extends into the drive channel 58 and includes a cylindrically contoured guide surface 82 as illustrated, for example, in FIG. 5. The cylindrically contoured guide surface 82 faces the guide face 62 face of the pendulum member 60. The contoured guide surface 82 receives the tip of a fastener as the fastener is exiting the drive channel 58 when the head of the fastener contacts the guide face 62 of the pendulum member 60. The fastener kicks forward from the guide face 62 of the pendulum member 60 into the guide surface 82 of the guide member 80.

Surfaces on the lower portion 50 of the body 42 of the adaptor 40 are chamfered by removing material from the lower portion 50 of the body. The chamfered surfaces 51 provide the user with visibility of the guide member 80 protruding from the lower portion of the adaptor 40. With the visibility provided by the chamfered surfaces 51, the user is able to see where the guide member 80 contacts the metal connector MC. In addition, the chamfering of the adaptor body 42 results in a reduced weight of the adaptor 40.

The adaptor 40 further includes a push button or button member 84 mounted fixedly to the body. The button member 84 extends laterally from the body in a direction away from the magazine assembly 20. The button member 84 is adapted to be manually depressed to reposition the claws 64 from the closed position to the open position. The claws 64 are biased closed by the torsion spring. In this position, the proximal end 66 of the claws 64 push the button member 84 outward from the body 42. When the button member 84 is pressed, it pushes against the proximal ends of the claws 64 and against the bias of the torsions springs 72, and opens the claws 64. When the claws 64 are open, the lower contact arm 34 with nosepiece assembly 16 can be inserted into the drive channel 58. As the claws 64 are normally biased closed by the torsion springs 72, when the button member is released, the claws can then return to the biased position and close over the lower contact arm 34 and hold the arm in place within the adaptor 40.

In a second embodiment of the present invention illustrated, for example, in FIGS. 7-10, an adaptor 240 is formed with an alternative guide member 280 and drive channel 258. Like reference numbers indicate the same element in the embodiments. With reference to FIGS. 7-10 the adaptor 240 can be coupled to an end of the lower contact arm portion 34. The adaptor 240 is illustrated to include a body 242 having a front portion 244 facing away from the magazine assembly 20, a rear portion 246 facing toward the magazine, an upper portion 248 facing the tool housing 12 and a lower portion 250 configured to be positioned adjacent to the workpiece WP.

Figure 7:
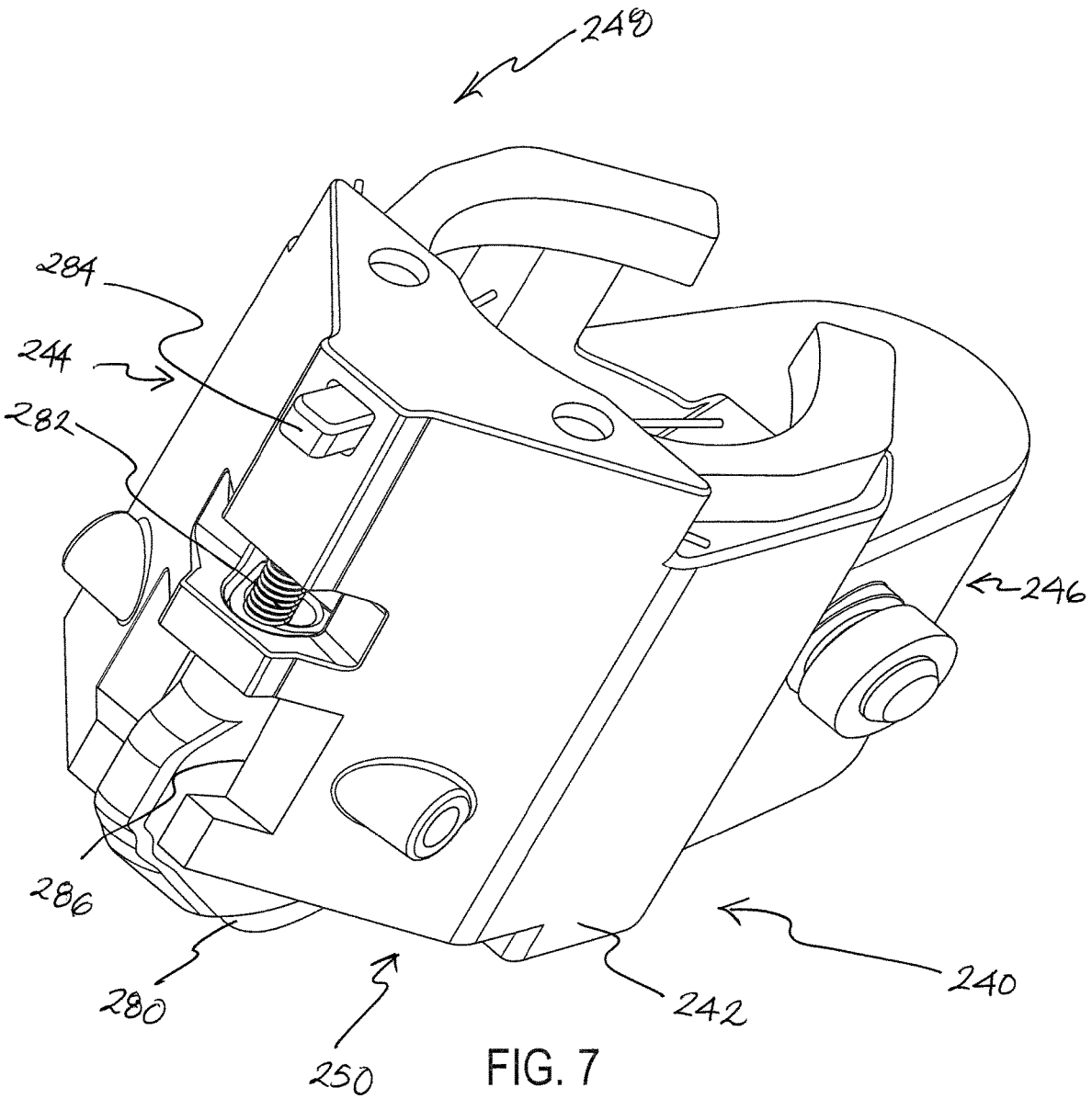
FIG. 7 is a perspective view of a metal connector adaptor according to a second embodiment of the present invention.
Figure 8:
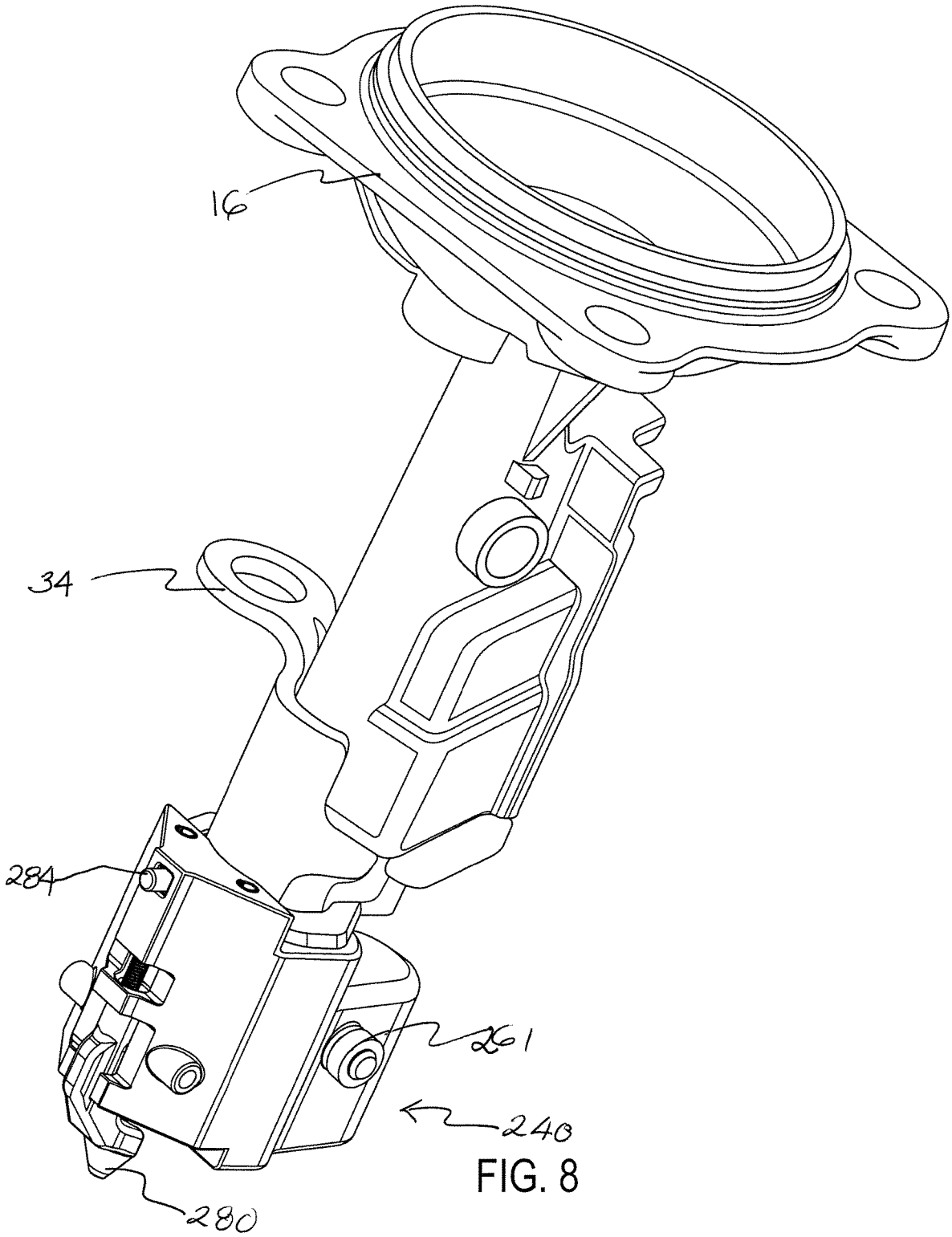
FIG. 8 is a perspective view of the metal connector adaptor, as installed on a lower contact arm of a fastening tool, according to the embodiment of FIG. 7.
Figure 9:
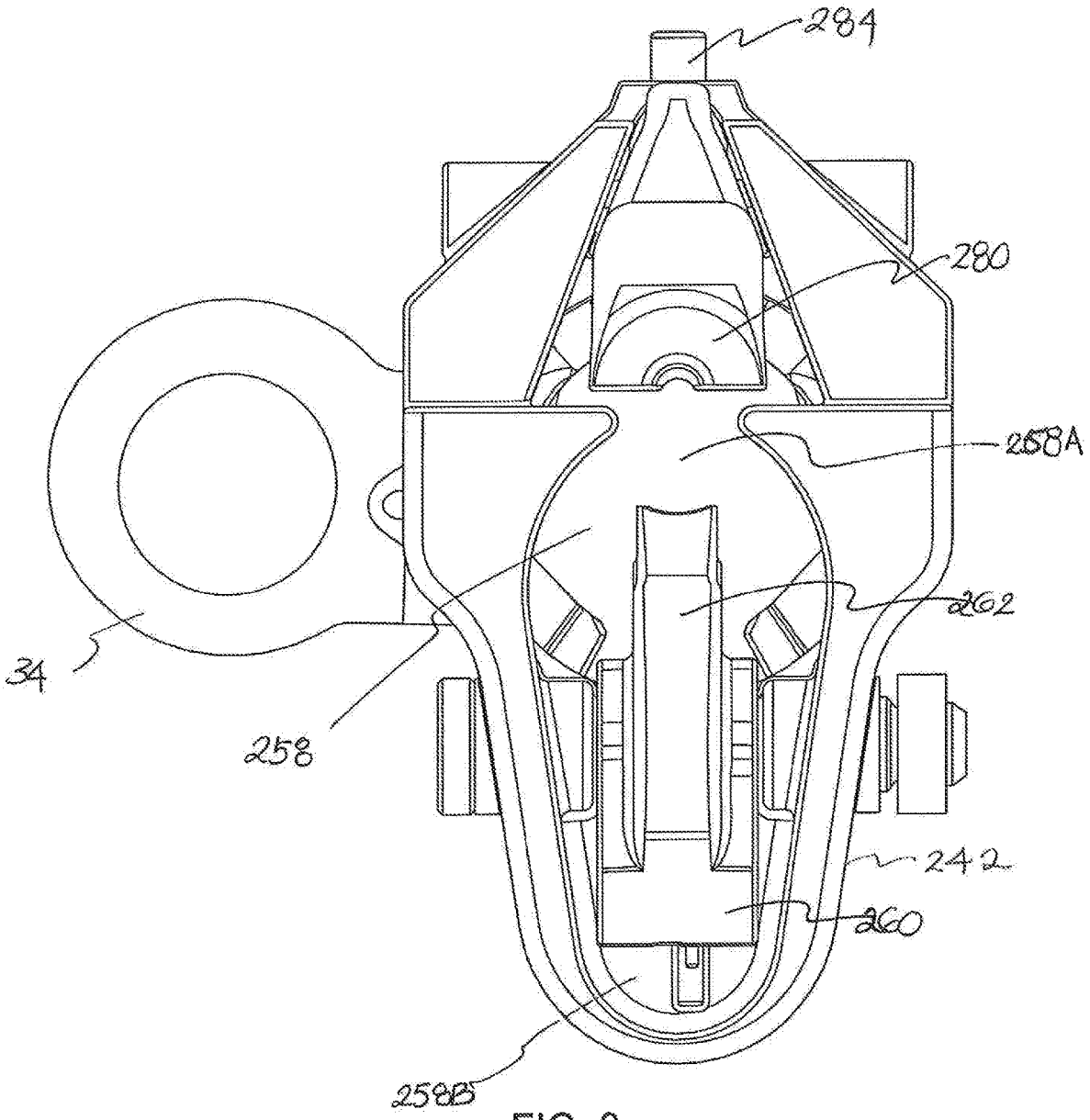
FIG. 9 is a bottom view of the metal connector adaptor according to the embodiment of FIG. 7.
Figure 10:
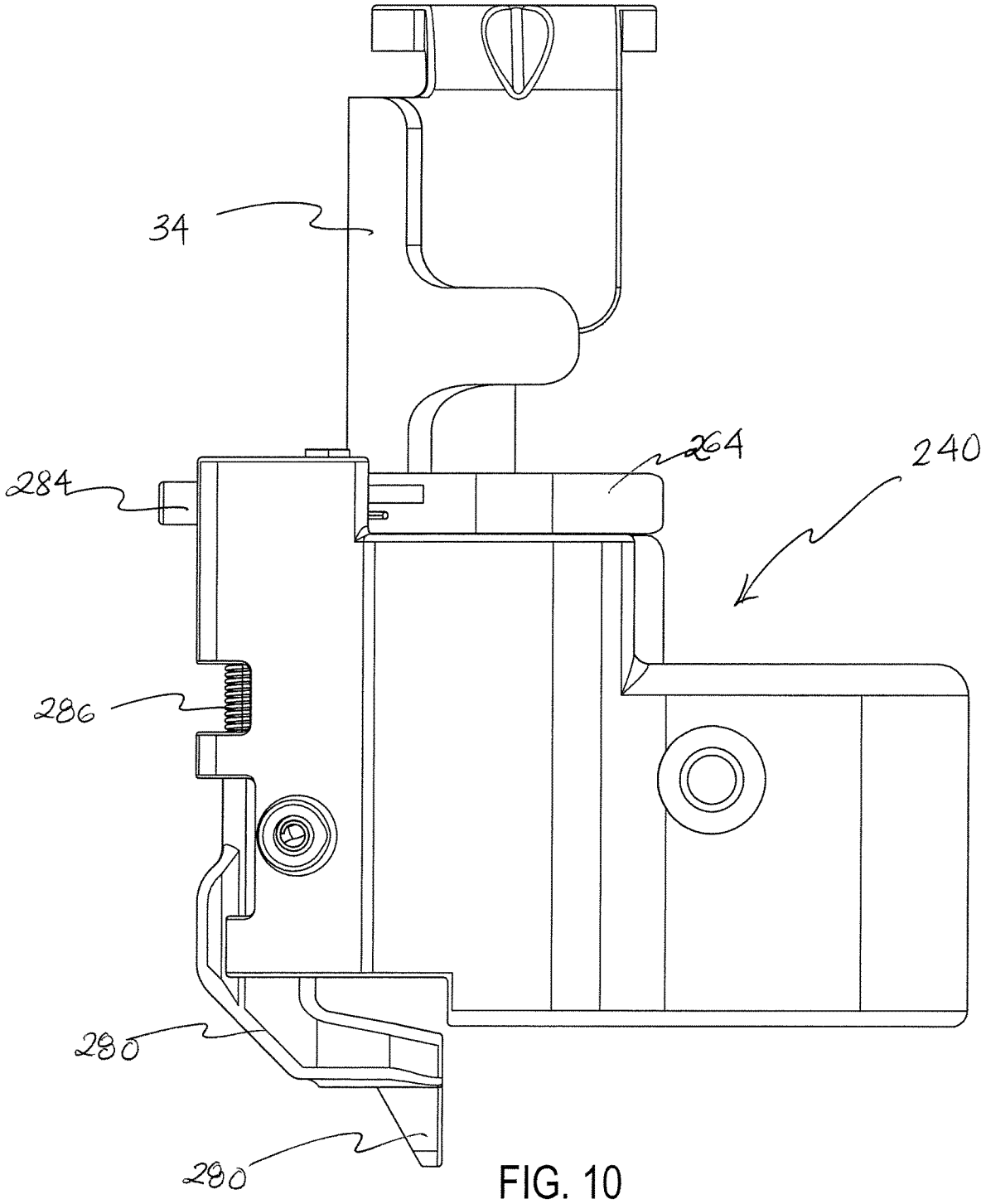
FIG. 10 is a side view of the metal connector adaptor, as installed on a lower contact arm of a fastening tool, according to the embodiment of FIG. 7.

As illustrated for example, in FIG. 7, the body 242 of the adaptor 240 includes a longitudinal drive channel 258 through a center portion thereof. The drive channel 258 extends from the upper portion 248 to the lower portion 250 of the body 242. A forward section 258A of the drive channel 258 seats the lower contact arm 34 within the adaptor 240. A rear section 58B of the drive channel 258B contains a pendulum member 260 pivotably connected to the body 242. The pendulum member 260 pivots on a pin 261 inserted laterally through the adaptor body in a direction perpendicular to the longitudinal aperture that forms the drive channel 258. The pendulum member 260, similar to the first embodiment, can have a triangular shape including a guide face 262 that faces the front portion 244 of the adaptor body 242. The guide face 262 of the pendulum member 260 includes a concave surface facing the drive channel 258. The guide face 262 serves as a contact surface for the tip of a fastener that is exiting the drive track 18 of the nosepiece assembly 16 and is entering the drive channel 258. The pendulum member 260 keeps the tips of the fasteners pointed toward the front portion 244 of the adaptor body 242 so that the tip of the fastener enters the hole H in the metal connector MC In the second embodiment, as shown in FIGS. 7 and 9, the guide member 280 is moveable and rides within a forward portion of the drive channel. The guide member 280 moves in a direction that is parallel to the drive channel 258. In addition, the guide member 280 is biased by a spring, such as, for example, a coil spring 282, outward and toward the workpiece WP. The chamfered outer surfaces of the adaptor also include a notch portion 286 adapted to restrict the lateral movement of the guide member 280.

The adaptor 240 of the second embodiment also includes a push button or button member 284 that pushes against the proximal end of the claws 264 to force the claws to open so that the lower contact arm 34 can be admitted into the drive channel. Upon release of the push button 284, the claws 264 close over the lower contact arm 34 and retain the lower contact arm portion within the drive channel of the adaptor 240.

In an embodiment of the present invention, a method of attaching the adaptor to the contact arm of the fastening tool includes pushing the button member of the front face of the adaptor against the proximal ends of the pair of claws to push open the pair of claws, inserting the lower contact arm of the contact arm assembly into the drive channel of the adaptor and releasing the button member so that the tension springs mounted in the cavities of each claw bias the claw toward the drive channel in a closed position around the lower contact arm.

In view of the foregoing, an advantage of the present invention is in ease and speed of installation and tool free installation of the adaptor that can be used in metal connector fastening.

While aspects of the present invention are described herein and illustrated in the accompanying drawings in the context of a pneumatic fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

We claim:

1. An adaptor comprising:

a body having a front portion, a rear portion, an upper portion, a lower portion and a drive channel extending in a direction from the upper portion to the lower portion;

a pendulum member pivotally connected to the body by a pin defining a pivot axis passing through a center portion of the drive channel, the pendulum member being biased about the pivot axis toward the drive channel;

a pair of claws pivotably connected to the body and surrounding the drive channel the pair of claws having an open position and a closed position and being biased in the closed position;

a guide member fixedly disposed within and on an opposite side of the drive channel and facing the pendulum member, the guide member having a portion protruding from the lower portion of the body for aligning the adaptor with designated holes in a metal connector, and a button member mounted fixedly and extending laterally from the body, the button member being adapted to be manually depressed to reposition the pair of claws from the closed position to the open position.

2. The adaptor according to claim 1, wherein each claw of the pair of claws has a proximal end that is pivotally connected to the front portion of the body and a distal free end extending toward the rear portion of the body.

3. The adaptor according to claim 1, further comprising roll pins inserted through the proximal end of the claws, wherein each claw pivots about a roll pin on axes parallel to the drive channel.

4. The adaptor according to claim 3, wherein torsion springs are disposed around the roll pins and the pair of claws is biased by the torsion springs to push the button member laterally from the body.

5. The adaptor according to claim 1, wherein the pendulum member pivots about an axis lying in a plane perpendicular to the drive channel.

6. The adaptor according to claim 1, wherein the pendulum member comprises a guide face facing the drive channel.

7. The adaptor according to claim 1, wherein the guide member is tapered in a direction away from the lower portion of the body.

8. The adaptor according to claim 1, wherein the body has a plurality of chamfered surfaces.

9. The adaptor according to claim 1, wherein the body further comprises a plurality of surfaces on the upper portion of the body including a first ledge, a second ledge, and a third ledge arranged on different planes passing through the drive channel, the second ledge disposed between the first ledge.

10. The adaptor according to claim 1, further comprising a torsion spring circumscribing the pin, wherein the pendulum member is biased about the pivot axis toward the drive channel by the torsion spring.

11. The adaptor according to claim 1, wherein the pendulum member is biased at the pivot axis toward the drive channel.

12. A fastening tool comprising:

a housing;

a nosepiece assembly carried by the housing, the nosepiece assembly having a fastener drive track;

an engine carried by the housing and configured to drive a fastener out of the drive track and into a workpiece during a drive stroke;

a contact arm comprising an upper contact arm portion and a lower contact arm portion, the lower contact arm portion being movably mounted to the nosepiece assembly and operatively coupled to the upper contact arm portion;

a trigger configured to move the lower contact arm portion;

a magazine assembly constructed and arranged to feed successive leading fasteners from a supply of fasteners contained therein into the drive channel;

an adaptor being configured to receive the lower contact arm, the adaptor including:

a body having a front portion, a rear portion, an upper portion and a lower portion, and a drive channel through a center portion thereof for receiving the lower contact arm;

a pendulum member pivotally connected to the body by a pin defining a pivot axis passing through a center portion of the drive channel, the pendulum member being biased about the pivot axis toward the drive channel;

a pair of claws pivotably connected to the body and surrounding the lower contact arm portion in the drive channel, the pair of claws having an open position and a closed position and being biased in the closed position;

a guide member that guides a fastening member from the magazine assembly, the guide member fixedly disposed within and on an opposite side of the drive channel and facing the pendulum member, the guide member having a portion protruding from the lower portion of the body, and a button member mounted fixedly and extending laterally from the body, the button member being adapted to be manually depressed to reposition the pair of claws from the closed position to the open position.

13. The fastening tool according to claim 12, wherein the guide member comprises cylindrical contour that faces the magazine assembly.

14. The fastening tool according to claim 12, wherein a front face of the pendulum member faces the cylindrical contour of the guide member.

15. The fastening tool according to claim 12, wherein the pair of claws contact the lower contact arm portion.

16. The fastening tool according to claim 12, wherein the pair of claws is biased inward toward the lower contact arm portion.

17. An adaptor comprising:

a body having a front portion, a rear portion, an upper portion, a lower portion and a drive channel extending in a direction from the upper portion to the lower portion;

a pendulum member pivotally connected to the body by a pin disposed perpendicular to the drive channel, the pin defining a first pivot axis, the pendulum member being biased about the first pivot axis toward the drive channel;

a pair of claws pivotably connected to the body and surrounding the drive channel, the pair of claws having an open position and a closed position and being biased in the closed position;

a guide member fixedly disposed within and on an opposite side of the drive channel and facing the pendulum member, the guide member having a portion protruding from the lower portion of the body for aligning the adaptor with designated holes in a metal connector, and a button member mounted fixedly and extending laterally from the body, the button member being adapted to be manually depressed to reposition the pair of claws from the closed position to the open position.

18. The fastening tool according to claim 17, wherein the pair of claws is biased in the closed position about second pivot axes parallel to the drive channel.

* * * * *